US009290954B2

(12) United States Patent
Taylor

(10) Patent No.: US 9,290,954 B2
(45) Date of Patent: Mar. 22, 2016

(54) METHOD AND APPARATUS OF AN ADJUSTABLE SCAFFOLD SHELF

(76) Inventor: Anthony Shane Taylor, Albert Lea, MN (US)

( * ) Notice: Subject to any disclaimer, the term of this patent is extended or adjusted under 35 U.S.C. 154(b) by 992 days.

(21) Appl. No.: 13/307,368

(22) Filed: Nov. 30, 2011

(65) Prior Publication Data

US 2012/0211616 A1 Aug. 23, 2012

Related U.S. Application Data

(60) Provisional application No. 61/445,798, filed on Feb. 23, 2011.

(51) Int. Cl.

| | |
|---|---|
| ***E04G 1/30*** | (2006.01) |
| ***E04G 1/34*** | (2006.01) |
| ***E04G 5/06*** | (2006.01) |

(52) U.S. Cl.

CPC .. *E04G 1/30* (2013.01); *E04G 1/34* (2013.01); *E04G 5/061* (2013.01); *Y10T 29/49* (2015.01)

(58) Field of Classification Search

CPC .. A47B 96/027; A47B 96/061; A47B 96/067; A47B 57/42; A47B 57/46; A47B 57/52; A47B 57/56; A47B 57/045; A47B 57/06; A47B 57/30; E04G 5/006; E04G 5/00; E04G 5/06; E04G 7/06; E04G 7/02; E04G 7/08; E04G 7/10; E04G 1/30; E04G 1/34; E04G 5/061; Y10T 29/49

See application file for complete search history.

(56) References Cited

U.S. PATENT DOCUMENTS

| | | | | |
|---|---|---|---|---|
| 4,098,480 | A * | 7/1978 | Neumann | 248/243 |
| 5,775,655 | A * | 7/1998 | Schmeets | 248/240 |
| 5,845,743 | A * | 12/1998 | Dechant | 182/187 |
| 6,116,163 | A * | 9/2000 | Mitchell | 108/42 |
| 6,322,178 | B1 * | 11/2001 | Dominique | 312/330.1 |
| 8,210,312 | B1 * | 7/2012 | Tetreault, Jr. | 182/119 |
| 2002/0084141 | A1 * | 7/2002 | Thomas | 182/82 |
| 2003/0136609 | A1 * | 7/2003 | Severt | 182/82 |
| 2005/0103569 | A1 | 5/2005 | Winter | |
| 2006/0124392 | A1 * | 6/2006 | Evinger et al. | 182/82 |
| 2007/0175370 | A1 * | 8/2007 | Paquin | 108/152 |
| 2008/0310910 | A1 * | 12/2008 | Chick | 403/49 |
| 2009/0081012 | A1 * | 3/2009 | Hafendorfer et al. | 414/387 |
| 2009/0218166 | A1 * | 9/2009 | Newton | 182/129 |

FOREIGN PATENT DOCUMENTS

| | | | |
|---|---|---|---|
| GB | 1311569 | A * | 3/1973 |
| RU | 37128 | U1 | 4/2004 |
| RU | 93850 | U1 | 5/2010 |

* cited by examiner

*Primary Examiner* — Charles A Fox
*Assistant Examiner* — Kristine Florio

(57) ABSTRACT

A method and apparatus of producing an adjustable scaffold shelf. The adjustable scaffold shelf is produced from a platform support of an existing scaffold by specific cuts. A middle support and a pair of mount supports are created from the existing platform support. The pair of mount supports is fastened to the middle support to create the frame for the adjustable scaffold shelf. A shelf platform is a board fitted onto the middle support and the pair of mount supports to complete the adjustable scaffold shelf.

9 Claims, 7 Drawing Sheets

METHOD AND APPARATUS OF AN ADJUSTABLE SCAFFOLD SHELF

The current application claims a priority to the U.S. Provisional Patent application Ser. No. 61/445,798 filed on Feb. 23, 2011.

FIELD OF THE INVENTION

The present invention relates generally to an adjustable shelf for a rolling scaffold. More specifically, a user is able to shift the adjustable shelf on a rolling scaffold to different heights.

BACKGROUND OF THE INVENTION

Traditionally, scaffolds are temporary structures used for construction or repair of buildings to support people and materials. The scaffolds allow construction workers or repair men to stand on an elevated surface that allows them to access an elevated area of a building that requires work. However, the traditional scaffold only provides a support with a simple platform. Construction workers or repairmen are required to lay their tools and materials directly onto the platforms they are working on. Consequently, to reach their tools and needed materials, the construction workers or repairmen need to bend over and reach for their needed items. Being on an elevated surface, it is important for the construction workers or repair men to maintain their stability for control. Furthermore, bending over or squatting just to reach tools or materials can be straining on the user's back and cause imbalance. As a result, the user is placed in danger of potentially falling and getting injured. The present invention overcomes this problem by presenting an adjustable shelf that utilizes the support of any traditional scaffold. The adjustable shelf provides a designated surface in which the user is able to place any needed materials and tools. Additionally, the adjustable shelf can be further elevated to eliminate the need for the user to crouch and reach for tools and materials.

DETAIL DESCRIPTIONS OF THE INVENTION

All illustrations of the drawings are for the purpose of describing selected versions of the present invention and are not intended to limit the scope of the present invention.

A traditional scaffold is made from five different parts. These parts include two ladder support frames 11 with horizontal rungs and wheel casters attached to the bottom, two platform supports 1 and the platform. The two platform supports 1 house the mechanisms that allow the support to be removed from the ladder frames and adjusted. These components are made specific to each company's own designs. However, the components are universally made with the intention of being able to be removed and replaced depending on the height needed to perform work. The idea of the present invention is to use the platform supports 1 as the shelf. The plat form supports (regardless of the manufacturer) already have the mechanisms that are needed to attach the shelf to the ladder support frames 11. With only a few planned cuts with a saw, the platform supports 1 can be turned into a "U-shaped" shelf with the attachment mechanism on the same ends. The end result is a shelf that has each company's own locking and unlocking mechanism on the ends of the shelf and can then be used for their own scaffolds. The only remaining need is to add a piece of plywood as a surface platform. The plywood can be cut to specific dimensions depending on size of shelf supports used specific to each company's designs. It is necessary that each platform support that is used to make the present invention to be made from the same platform supports 1 used for a particular scaffold. The adjustable scaffold shelf is manufactured by cutting two mounting ends of the platform supports 1 to create a pair of mount supports 2. The middle segment of the platform support is created into the middle support of the adjustable scaffold shelf.

The invention is able to function with a manufacturer's own scaffold as it is made from an already existing part of the company's scaffold. The platform supports 1 attach to the ladder support frames 11 and are made with the ability to shift up and down. As a result, the adjustable scaffold shelf is able to do the same.

Figure 5:
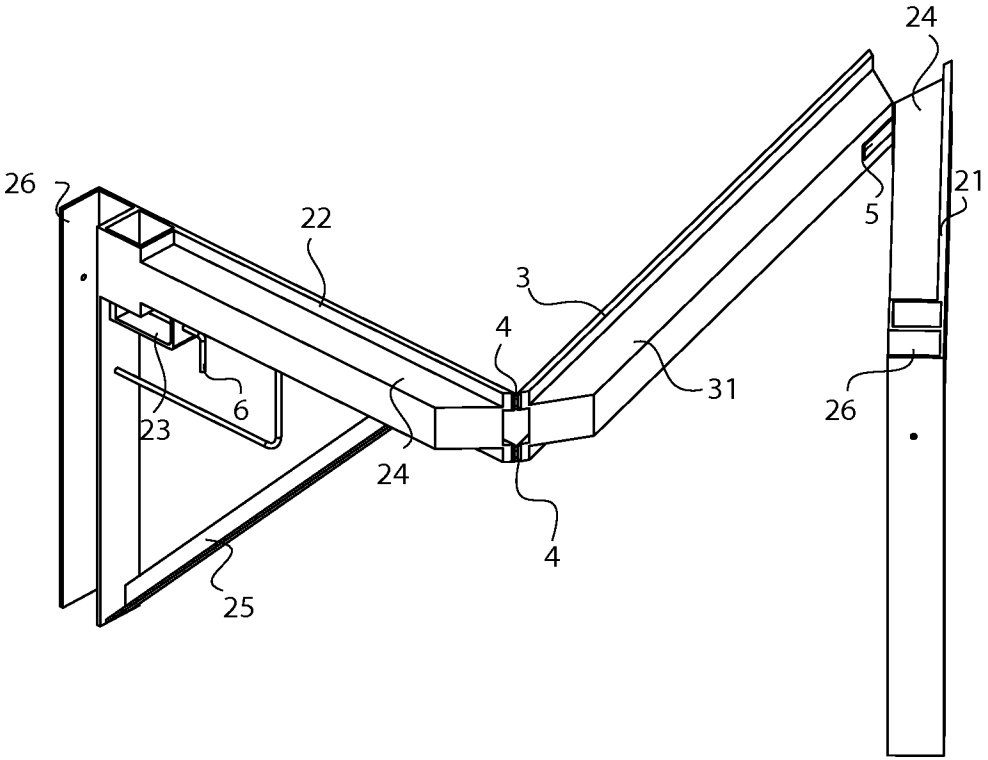
FIG. 5 is a perspective view of the middle support and the pair of mount supports, showing the pair of mount supports being folded into towards the middle support.
Figure 6:
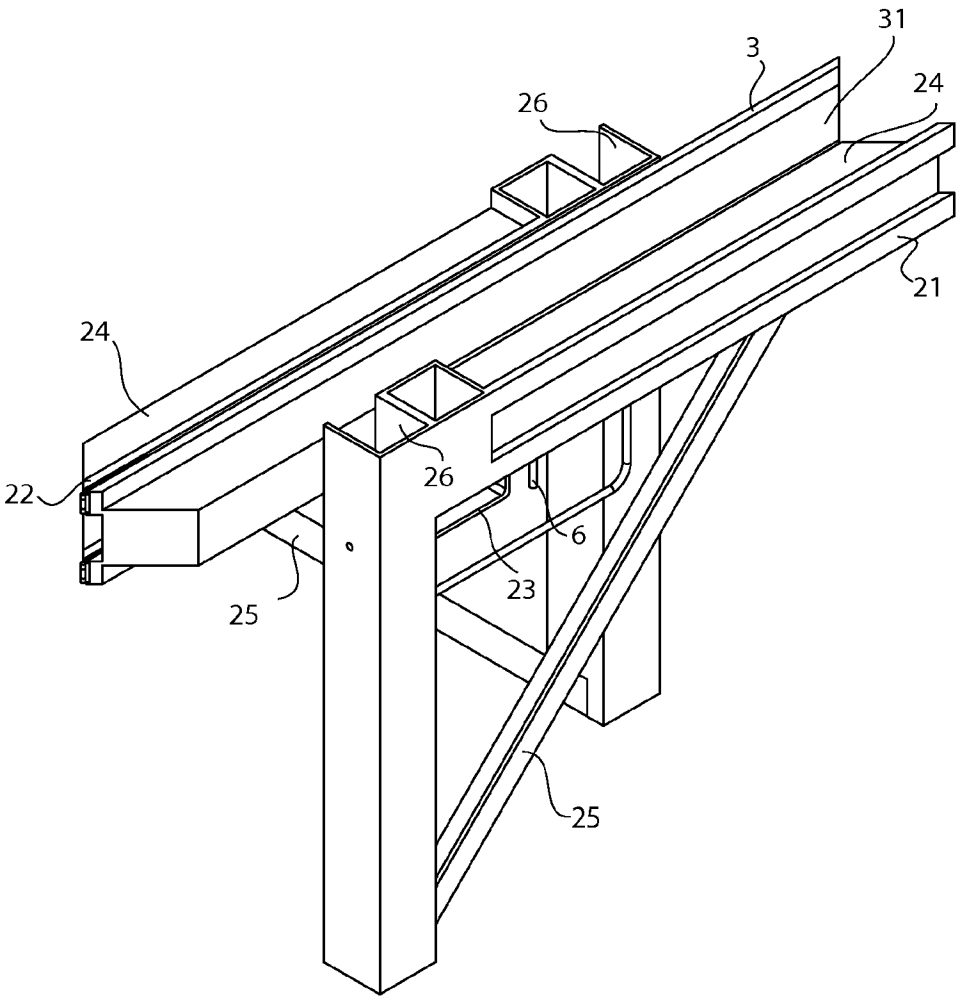
FIG. 6 is a perspective view of the middle support and the pair of mount supports, showing the collapsibility.
Figure 7:
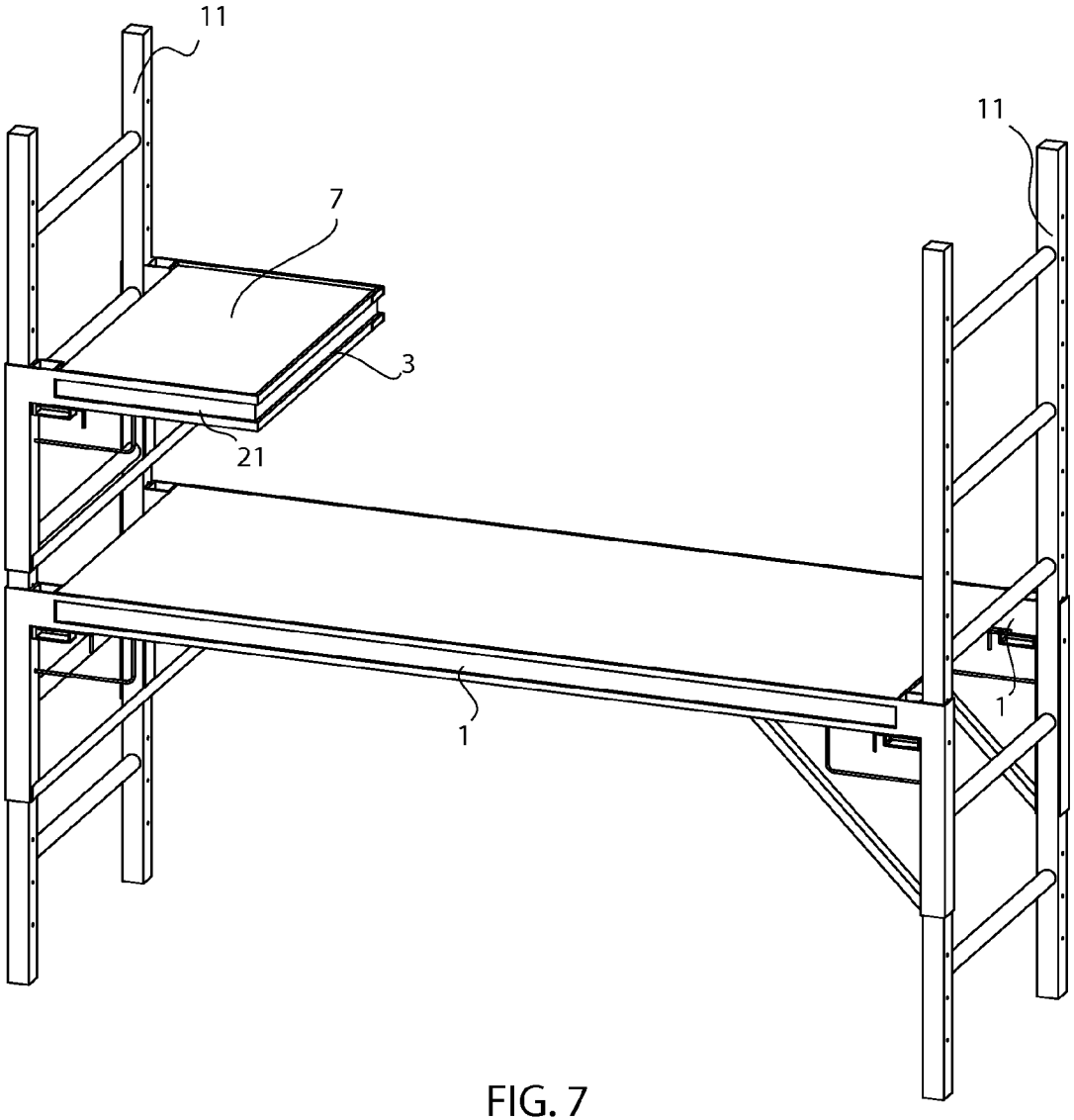
FIG. 7 is a perspective view of the present invention being secured onto the ladder support frame of a scaffold.

The present invention is the adjustable shelf that can be mounted onto any scaffold support that comprises of a frame with two vertical bars including the rolling scaffold. The adjustable shelf can be adjusted up and down a scaffold support frame. When the adjustable shelf is not being used, the user can simply remove the present invention from the scaffold support. The adjustable scaffold shelf is also collapsible for compact storage. In reference to FIG. 5-6, the adjustable scaffold shelf comprises a pair of mount supports 2, a middle support, an outer hinge 4, an inner hinge 5, a pair of spring loaded pins 6, and a shelf platform 7. The pair of mount supports 2 is used to mount the adjustable scaffold shelf to the frame of a scaffold support. The middle support is a middle segment of the frame for the adjustable scaffold shelf. In the preferred embodiment of the present invention, the middle support is the longest segment of the adjustable scaffold shelf frame. This allows the adjustable scaffold shelf to match the width of the ladder support frame 11. The outer hinge 4 and the inner hinge 5 connect the middle hinge to the pair of mount supports 2 to provide the adjustable scaffold shelf collapsibility. The pair of spring loaded pins 6 allows the adjustable scaffold shelf to be secured to different levels on a scaffold support frame.

Figure 1:
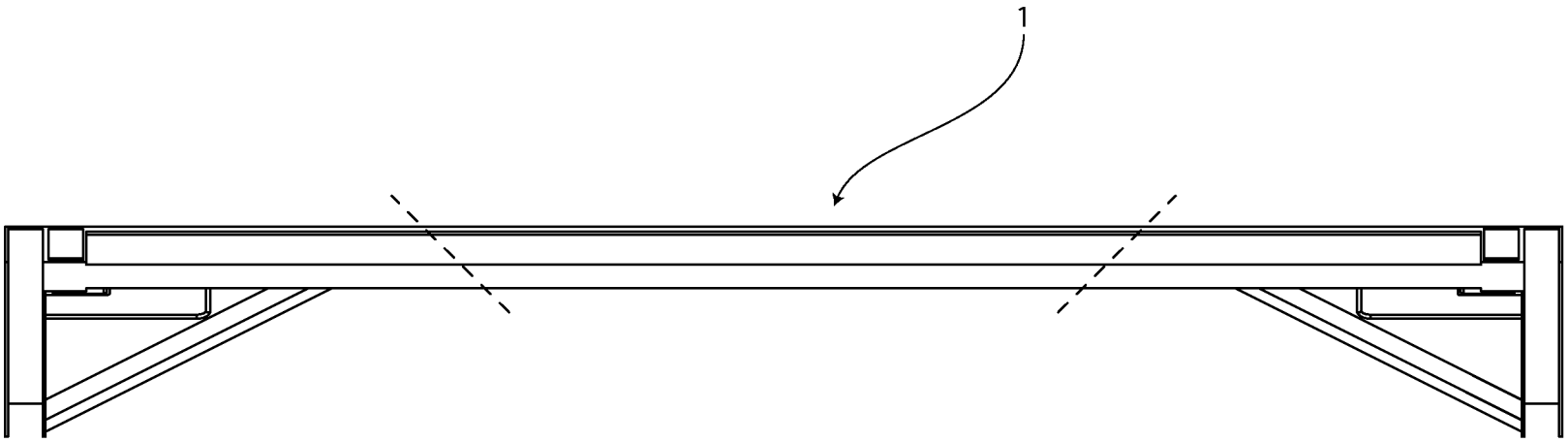
FIG. 1 is a view of the platform scaffold being cut at an angle to form the middle support and the pair of mount supports. The dotted lines represent the cut to be made on the platform support.
Figure 2:
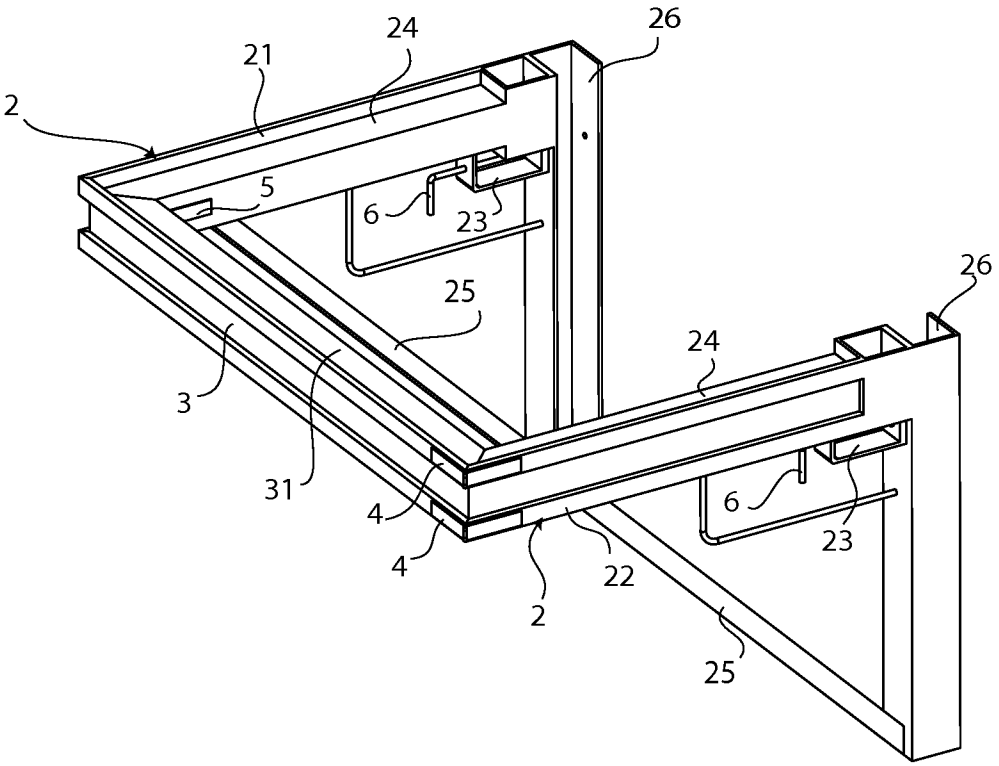
FIG. 2 is a perspective view of the middle support being connected to the pair of mount support by the outer hinge and the inner hinge.
Figure 3:
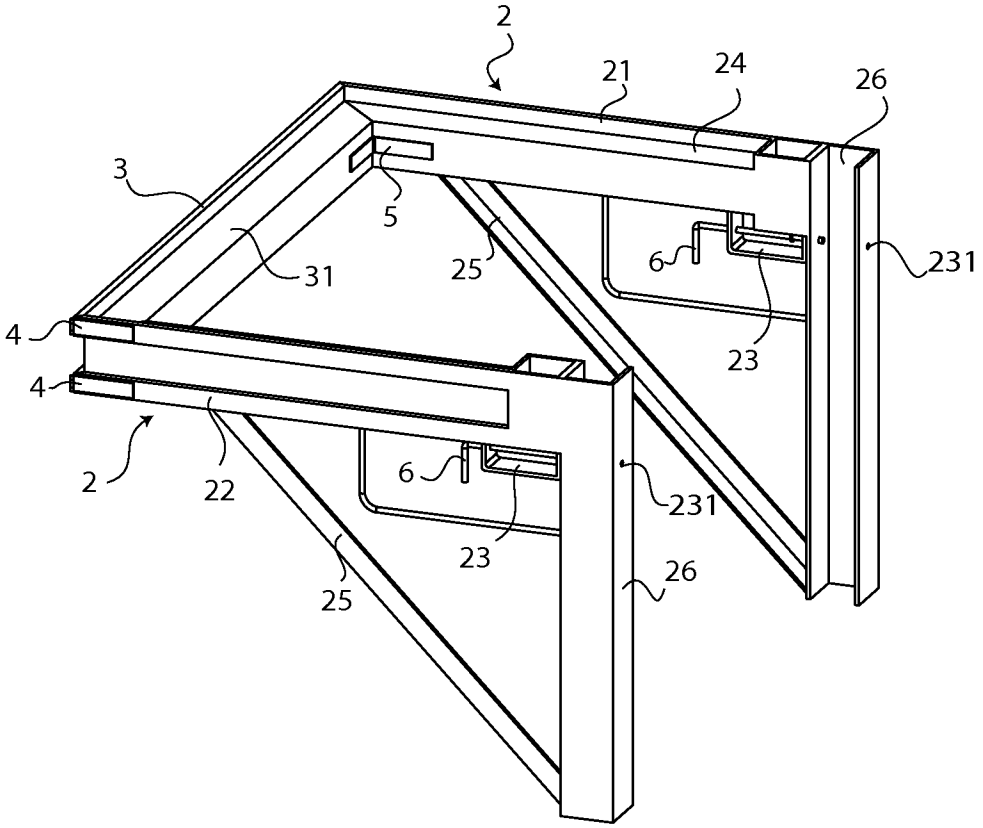
FIG. 3 is a perspective view of the middle support being connected to the pair of mount support by the outer hinge and the inner hinge.
Figure 4:
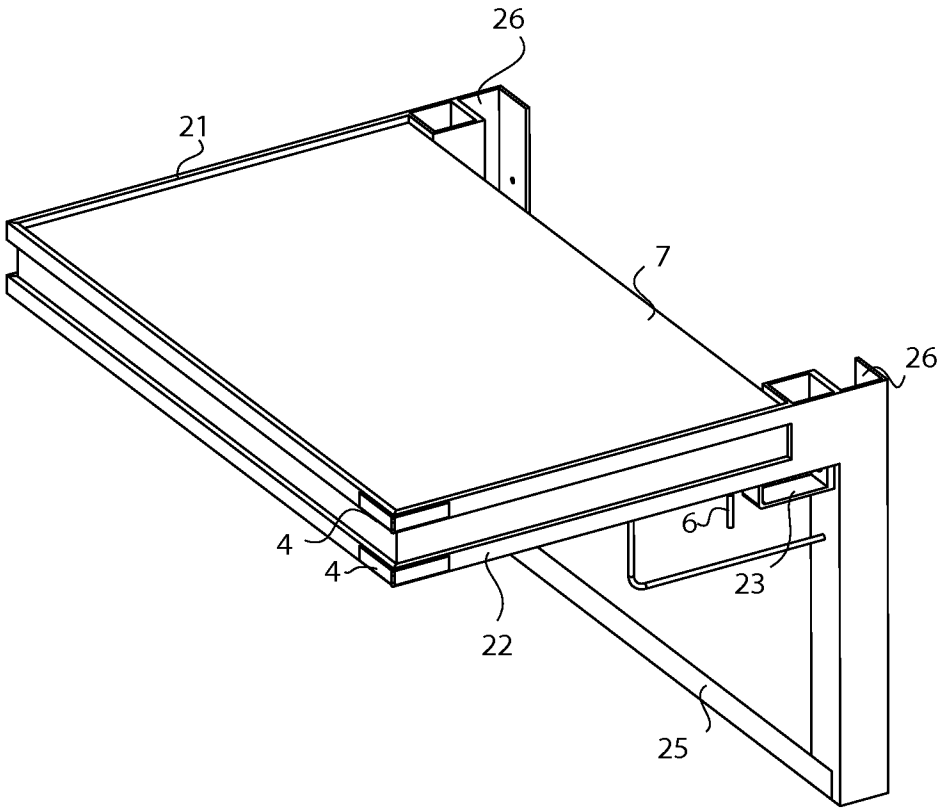
FIG. 4 is a perspective view of the present invention with the shelf platform being fitted onto the middle shelf ledge and the shelf ledges.

In reference to FIG. 2-4, a first mount support 21 and a second mount support 22 each further comprises a shelf ledge 24, a shelf support bar 25, a shelf pin mount 23 and a shelf scaffold channel 26. The middle mount segment 3 comprises a middle shelf ledge 31. The first mount support 21 is jointly connected to the middle support. The second mount support 22 is jointly connected to the end of the middle support opposite of the first mount support 21. The platform support is cut at an angle to provide the middle mount segment 3 with a first end and a second end that are angled. The first end and the second end of the middle support are connected with corresponding angled ends of the pair of mount supports 2 to form two perpendicular corners. As a result, the first mount support 21 and the second mount support 22 are positioned in perpendicular relationship to the middle support. The middle segment and the pair of mount supports 2 define a U-shaped rectangular frame. With the middle segment and the pair of mount supports 2 being connected, the shelf ledge 24 of both the first mount support 21 and the second mount support 22 is aligned to the middle shelf ledge 31. The shelf ledge 24 of the pair of the mount supports and the middle shelf ledge 31 are aligned to the inner side of the U-shaped rectangular frame. The shelf platform 7 is a flat board that is shaped to fit within the U-shaped rectangular frame. The shelf platform 7 is positioned on the middle shelf ledge 31 and the shelf ledge 24 of the first mount support 21 and the second mount support 22. When the adjustable scaffold shelf is secured to the scaffold support frame, the shelf platform 7 provides the surface in which the user is able to place their tools and building materials.

On the ends of the pair of mount supports 2 is positioned the shelf scaffold channel 26. The shelf scaffold channel 26 is a channel that allows the adjustable scaffold shelf to mount to the support frame of a scaffold. The shelf scaffold channel 26 is shaped to conform to the shape of any scaffolding frame. The shelf scaffold channel 26 is downwardly extended from each of the mount support on a mount end of the mount supports opposite to the middle support. To provide middle shelf ledge 31 and the shelf ledge 24 with additional support, the shelf support bar 25 is extended at an angle from each of the mount supports and is connected to the shelf scaffold channel 26. As a result, each of the mount supports 2 forms a right triangle shape.

In reference to FIG. 3, positioned adjacently to the shelf scaffold channel 26 and the mount support is the shelf pin mount 23. The shelf pin mount 23 is connected directly to both the mount support and the shelf scaffold channel 26. The shelf pin mount 23 further comprises of a pin hole. The pin hole is a hole that is traversed through the shelf pin mount 23 and the shelf scaffold channel 26. The pair of spring loaded pins 6 is secured to the shelf pin mount 23 and is traversed through the pin hole of each of the mount supports. The spring loaded pins 6 are normally traversed into the shelf scaffold channel 26 and serve to secure each of the mount supports to the holes of the scaffold frames. The spring loaded pins 6 are positioned in the shelf pin mount 23 with the spring pushing the pin towards the shelf scaffold channel 26. With the adjustable scaffold shelf fastened to a scaffold frame, the user can simply pull on the spring loaded pins 6 to release the scaffold shelf from a hole for adjustment to another hole.

When a repair or building process is completed, the user is able to remove the adjustable scaffold shelf. To do so, the user can first lift the shelf platform 7 from the middle shelf ledge 31 and the shelf ledges 24. With the shelf platform 7 removed, the user is able to release the shelf scaffold channels 26 from the scaffold support frame by releasing the pair of spring loaded pins 6. As a result, the adjustable scaffold shelf is free and foldable for storage. The outer hinge 4 and the inner hinge 5 allow the pair of support mounts to fold towards the middle support. The inner hinge 5 is connected to the first mount support 21 and the middle support adjacent to the shelf ledge 24 and the middle shelf ledge 31. The outer hinge 4 is connected to the outer surface of the second mount support 22 and the middle support. The inner hinge 5 provides the first mount support 21 with 90 degrees of freedom and allows the first mount support 21 to fold in towards middle support. The outer hinge 4 provides the second mount support 22 with 270 degrees of freedom to pivot in towards the outer surface of the middle support.

The present invention can be used to perform various tasks whether it is mounted on the inside or outside of the ladder support frame 11. Some companies may manufacture the scaffold adjusting holes for the platform supports 1 on the inner side of the ladder support frames 11 while some other companies may manufacture the holes on the outer side.

The present invention can be made by each company taking their own platform supports 1 and cutting the platform supports 1 to create the adjustable scaffold shelf.

Although the invention has been explained in relation to its preferred embodiment, it is to be understood that many other possible modifications and variations can be made without departing from the spirit and scope of the invention as hereinafter claimed.

What is claimed is:

1. An adjustable scaffold shelf comprises,
- a pair of mount supports;
- a middle support;
- an outer hinge;
- an inner hinge;
- a pair of spring loaded pins;
- a shelf platform;
- each mount support comprises a shelf ledge, a shelf support bar, a shelf pin mount, and a shelf scaffold channel;
- a middle mount segment comprises a middle shelf ledge;
- wherein the pair of mount supports includes a first mount support and a second mount support;
- the first mount support being jointly connected to the middle support;
- the second mount support being jointly connected to the middle support;
- the shelf ledge of the pair of mount supports being in a common plane with the middle shelf ledge;
- the inner hinge being connected to the first mount support and the middle support adjacent to the shelf ledge and the middle shelf ledge;
- the outer hinge being connected to the second mount support and the middle support;
- the pair of spring loaded pins being secured by the pin mount; and
- the shelf platform being positioned on the middle shelf ledge and the shelf ledge of the first mount support and the second mount support.

2. The adjustable scaffold shelf as claimed in claim 1 comprises,
- the shelf scaffold channel being downwardly extended from each mount support; and
- the shelf support bar being extended at an angle from each mount support and being connected to the shelf scaffold channel.

3. The adjustable scaffold shelf as claimed in claim 1 comprises,
- each pin mount being connected to each mount support and the shelf scaffold channel;
- the pin mount comprises a pin hole; and
- the pin hole being traversed through the pin mount and the shelf scaffold channel.

4. The adjustable scaffold shelf as claimed in claim 3 comprises,
- the pair of spring loaded pins being traversed through the pin hole, wherein a first spring loaded pin is secured by a first pin mount of the first mount support and a second spring loaded pin is secured by the second mount support.

5. The adjustable scaffold shelf as claimed in claim 1 comprises, the first mount support and the second mount support being positioned in perpendicular relationship to the middle support.

6. A method of creating the adjustable scaffold shelf of claim 1 comprises, cutting the platform support into the middle support and the pair of mount supports, wherein the pair of mount supports include the first mount support and the second mount support;

fastening the pair of mount supports to the middle support by the outer hinge and an inner hinge;

wherein the first mount support is fastened to a first end of the middle support by the inner hinge;

wherein the second mount support is fastened to a second end of the middle support by the outer hinge;

fastening the pair of mount supports to a ladder support frame; and fitting of the shelf platform onto the middle support and the pair of mount supports.

7. An adjustable scaffold shelf comprises, a pair of mount supports;

a middle support;

an outer hinge;

an inner hinge;

a pair of spring loaded pins;

a shelf platform;

each mount support comprises a shelf ledge, a shelf support bar, a shelf pin mount, and a shelf scaffold channel;

a middle mount segment comprises a middle shelf ledge;

wherein the pair of mount supports includes a first mount support and a second mount support;

the first mount support being jointly connected to the middle support;

the second mount support being jointly connected to the middle support;

the shelf ledge of the pair of mount supports being in a common plane with the middle shelf ledge;

the inner hinge being connected to the first mount support and the middle support adjacent to the shelf ledge and the middle shelf ledge;

the outer hinge being connected to the second mount support and the middle support;

the first mount support and the second mount support being positioned in perpendicular relationship to the middle support; and the shelf platform being positioned on the middle shelf ledge and the shelf ledge of the first mount support and the second mount support.

8. The adjustable scaffold shelf as claimed in claim 7 comprises, the shelf scaffold channel being downwardly extended from each mount support; and the shelf support bar being extended at an angle from each mount support and being connected to the shelf scaffold channel.

9. The adjustable scaffold shelf as claimed in claim 7 comprises, each pin mount being connected to each mount support and the shelf scaffold channel;

the pin mount comprises a pin hole;

the pin hole being traversed through the pin mount and the shelf scaffold channel; and the pair of spring loaded pins being secured by the pin mount and being traversed through the pin hole, wherein a first spring loaded pin is secured by a first pin mount of the first mount support and a second spring loaded pin is secured by the second mount support.

* * * * *